US008292116B2

(12) United States Patent
Saito

(10) Patent No.: US 8,292,116 B2
(45) Date of Patent: Oct. 23, 2012

(54) OIL TANK STRUCTURE

(75) Inventor: Yasuhiro Saito, Tokoname (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 394 days.

(21) Appl. No.: 12/664,965

(22) PCT Filed: Apr. 17, 2008

(86) PCT No.: PCT/JP2008/057542

§ 371 (c)(1),
(2), (4) Date: Dec. 16, 2009

(87) PCT Pub. No.: WO2009/004851

PCT Pub. Date: Jan. 8, 2009

(65) Prior Publication Data

US 2010/0181326 A1 Jul. 22, 2010

(30) Foreign Application Priority Data

Jul. 3, 2007 (JP) ..... 2007-175659

(51) Int. Cl.
*B60P 3/00* (2006.01)
*B62D 33/00* (2006.01)
*B65D 88/12* (2006.01)

(52) U.S. Cl. ..... 220/563

(58) Field of Classification Search ..... 220/562–564, 220/669, 670, 672; 184/104.3, 106; 123/196 AB, 123/196 R See application file for complete search history.

(56) References Cited

U.S. PATENT DOCUMENTS 1,769,051 A * 7/1930 Burnham ..... 174/12 R
3,495,736 A * 2/1970 Ragettli ..... 220/670
2009/0145695 A1 6/2009 Hiramatsu

FOREIGN PATENT DOCUMENTS

JP 49-140518 12/1974

(Continued)

OTHER PUBLICATIONS

English language Abstract of JP 10-176515, Jun. 30, 1998.

(Continued)

*Primary Examiner* — Harry Grosso
(74) *Attorney, Agent, or Firm* — Greenblum & Bernstein, P.L.C.

(57) ABSTRACT

An object of the present invention is to provide an oil tank structure capable of cooling oil flowing into the oil tank to properly adjust the oil temperature, and also capable of preventing overcooling. The oil tank structure includes a tank portion; an oil introducing portion that is provided in a sidewall of the tank portion and introduces oil in a direction tangential to the sidewall; at least one groove-like passage portion that is formed along a circumference of the sidewall so to allow the introduced oil to flow in and out; an oil cooling portion that is provided on the sidewall and cools the groove-like passage portion; and an outlet formed in a bottom of the tank portion. By such an oil tank structure, oil having a high temperature easily flows into the groove-like passage portion due to its low viscosity, and is cooled by the oil cooling portion. On the other hand, oil having a low temperature is prevented from flowing into the groove-like passage portion, and is less likely to be cooled by the oil cooling portion. Accordingly, overcooling of the oil can be suppressed.

14 Claims, 9 Drawing Sheets

FOREIGN PATENT DOCUMENTS

| | | |
|---|---|---|
| JP | 2-67015 | 5/1990 |
| JP | 3-63707 | 6/1991 |
| JP | 3-95015 | 9/1991 |
| JP | 10-176515 | 6/1998 |
| JP | 2000-176204 | 6/2000 |

OTHER PUBLICATIONS

English language Abstract of JP 2000-176204, Jun. 27, 2000.
Japan Office action, dated Jan. 10, 2012 along with an english translation thereof.

* cited by examiner

OIL TANK STRUCTURE

TECHNICAL FIELD

The present invention generally relates to structures of oil tanks provided in internal combustion engines. More particularly, the present invention relates to oil tank structures capable of cooling oil flowing into the oil tank to properly adjust the oil temperature, and also capable of preventing overcooling. The oil tank structures can be applied to structures of oil tanks for internal combustion engines, especially for internal combustion engines of automobiles and the like.

BACKGROUND ART

In recent years, temperature control of oil that is used to lubricate internal combustion engines has been becoming increasingly important. This is because the temperature and the viscosity of oil are correlated with each other, and the oil viscosity needs to be maintained in a fixed range in order to maintain a constant oil film thickness. Moreover, oil that is discharged from a lubrication path of an internal combustion engine in use usually has a higher temperature than an appropriate temperature range. Thus, it has been considered to cool the oil to a temperature within the appropriate temperature range before it is supplied again to the lubrication path (see, for example, Patent Document 1 and Patent Document 2).

Patent Document 1: Japanese Patent Application Publication No. H10-176515

Patent Document 2: Japanese Patent Application Publication No. 2000-176204

DISCLOSURE OF THE INVENTION

Problem to be Solved by the Invention

In Patent Document 1, an umbrella portion is provided so as to guide oil to an outer peripheral portion of an oil pan in which cooling fins are disposed, and the cooling fins release the heat of the oil that has reached the outer peripheral portion. However, although the oil in the oil pan sometimes has a temperature lower than an appropriate temperature range when, and right after, the engine is started, and the like, the cooling fins disposed in the outer peripheral portion of the oil pan constantly cool the oil in the oil pan. Thus, the oil is cooled even if the oil temperature is low, and it takes a long time for the oil to reach the appropriate temperature range. Thus, the oil viscosity becomes higher than an appropriate range until the oil reaches the appropriate temperature range, and there is a possibility that appropriate lubrication cannot be performed.

Patent Document 2 discloses an air-bubble removing apparatus provided in an intermediate position in a flow path from a lubrication path to an oil tank, in which the air-bubble removing apparatus is entirely cooled to control the oil temperature to an appropriate temperature range, while increasing the effect of separating air bubbles. However, since the air-bubble removing apparatus is entirely cooled in this structure, oil is constantly cooled as in the case of Patent Document 1. Therefore, it takes a long time for the oil to reach the appropriate temperature range when the oil has a low temperature.

The present invention was developed in view of the above problems, and it is an object of the present invention to provide an oil tank structure capable of cooling oil flowing into the oil tank to properly adjust the oil temperature, and also capable of preventing overcooling.

Means for Solving the Problem

One aspect of the present embodiments provides an oil tank structure, including a cylindrical tank portion; an oil introducing portion that is provided in a sidewall of the tank portion and introduces oil in a direction tangential to the sidewall; at least one groove-like passage portion that is formed along a circumference of the sidewall of the tank portion so to allow the introduced oil to flow in and out of the groove-like passage portion; an oil cooling portion that is provided on the sidewall of the tank portion and cools the groove-like passage portion; and an outlet formed in a bottom of the tank portion, and the groove-like passage portion is opened on a side of a central axis of the sidewall of the tank portion.

In a further aspect, the groove-like passage portion is tilted downward toward the central axis of the sidewall of the tank portion.

In a further aspect, a width of the groove-like passage portion is such a width that the introduced oil does not flow into the groove-like passage portion by a momentum of the oil when the oil has a low temperature, and the introduced oil flows into the groove-like passage portion by a momentum of the oil when the oil has a high temperature.

In a further aspect, the groove-like passage portion is provided in a spiral shape so as to extend downward along a direction in which the oil is introduced.

In a further aspect, the groove-like passage portion is provided such that a groove depth thereof gradually decreases from an upper position to a lower position on the sidewall, and/or a groove width gradually increases from the upper position to the lower position on the sidewall.

In a further aspect, a baffle portion is further provided within the tank portion so as to cover the outlet from above.

Effects of the Invention

According to the oil tank structure, as exemplarily shown in FIG. 5, oil is introduced from an oil introducing portion 13 in a direction tangential to a sidewall 12, whereby the oil moves downward while swirling along the sidewall 12. Thus, the oil necessarily flows on a groove-like passage portion 15 provided circumferentially on the sidewall 12. Moreover, since the oil mixes with stored oil while swirling, the stored oil also swirls in the same direction, and the periphery of the oil rises in a cone shape along the sidewall 12 due to the swirling force.

Moreover, oil having a high temperature easily flows into the groove-like passage portion 15 due to its low viscosity, and is cooled by an oil cooling portion 14. On the other hand, as exemplarily shown in FIG. 4, oil having a low temperature is pressed against the periphery of the groove-like passage portion 15 by a centrifugal force, but its high viscosity causes a large resistance to further inflow of the oil, preventing the oil from flowing further into the groove-like passage portion 15. Thus, the oil is less likely to be cooled by the oil cooling portion 14. Accordingly, overcooling of the oil can be suppressed.

Thus, cooling can be performed according to the temperature of the oil flowing into a tank portion 11, and the oil temperature in the tank portion 11 can be prevented from becoming higher than an appropriate temperature range. This can also suppress reduction in lubricating effect, which is caused by a high oil temperature because the oil film thickness on a lubrication path such as a bearing is reduced by reduced oil viscosity. Moreover, when the oil temperature is low, such as when an internal combustion engine is started or the like, the oil re-lubricates the object to be lubricated without being cooled. Thus, the time it takes for the oil temperature to increase to an appropriate temperature can be reduced.

Moreover, normal performance of the internal combustion engine can be obtained at an earlier stage.

Moreover, the resistance, which is produced by the oil flowing into the circumferentially provided groove-like passage portion 15, prevents the oil from easily moving in a vertical direction of the tank portion 11. Therefore, the height of the level of the stored oil that is stirred by the introduced oil can be prevented from varying significantly. Thus, the height of the oil tank can be reduced as compared to conventional oil tanks.

Moreover, since the introduced oil moves downward while swirling along the sidewall 12, air bubbles contained in the oil are centrifugally separated, whereby oil mixed with air bubbles can be prevented from being supplied again to the lubrication path.

When the groove-like passage portion 15 is tilted downward toward the central axis of the sidewall, the oil having a higher temperature can be made to more easily flow into the groove-like passage portion 15. At the same time, this structure can help the introduced oil flow downward, and can suppress an increase in level of the stirred stored oil. Thus, the cooling ability of the tank structure associated with changes in oil temperature varies significantly, and an increase in level of the oil stored in the tank portion 11 can further be suppressed.

When the groove-like passage portion 15 has such a width that the oil having a low temperature is less likely to flow into the groove-like passage portion 15, the degree to which the oil flows into the groove-like passage portion 15, due to the difference between the oil having a high temperature and the oil having a low temperature, can be varied significantly, and the cooling ability of the tank structure associated with changes in oil temperature can be varied significantly.

When the groove-like passage portion 15 is provided in a spiral shape, oil having a high temperature can more easily flow into the groove-like passage portion 15 while swirling, thereby facilitating cooling of the oil. Moreover, the introduced oil can more easily flow downward, so that the amount of oil that can be used for lubrication can be prevented from being substantially reduced due to stagnation of the oil.

When the groove-like passage portion 15 is provided such that the groove depth is gradually reduced toward downward and the groove width is gradually increased toward downward, even the oil having a flow rate gradually reduced by swirling in the tank portion 11 can easily flow into the groove-like passage portion 15 and can be cooled by the oil cooling portion 14.

In the case where a baffle portion 17 is provided, the level of the oil stored in the tank portion 11 can be prevented from being lowered down to an outlet 16 by stirring, and air bubbles, generated by, for example, pouring the introduced oil into the stored oil, can be prevented from moving down to the outlet 16. Thus, the oil mixed with air bubbles can be prevented from being supplied again to the lubrication path.

DESCRIPTION OF THE REFERENCE NUMERALS

1, 1*a*, 1*b*, 1*c*: oil tank; 11: tank portion; 12: sidewall; 13: oil introducing portion; 14: oil cooling portion; 15: groove-like passage portion; 16: outlet; 17: baffle portion; 2: internal combustion engine (object to be lubricated); 3, 4: pump; 51: introduced oil; and 52: stored oil.

Best Modes for Carrying Out the Invention

An oil tank structure of the present invention will be described in detail below.

Figure 1:
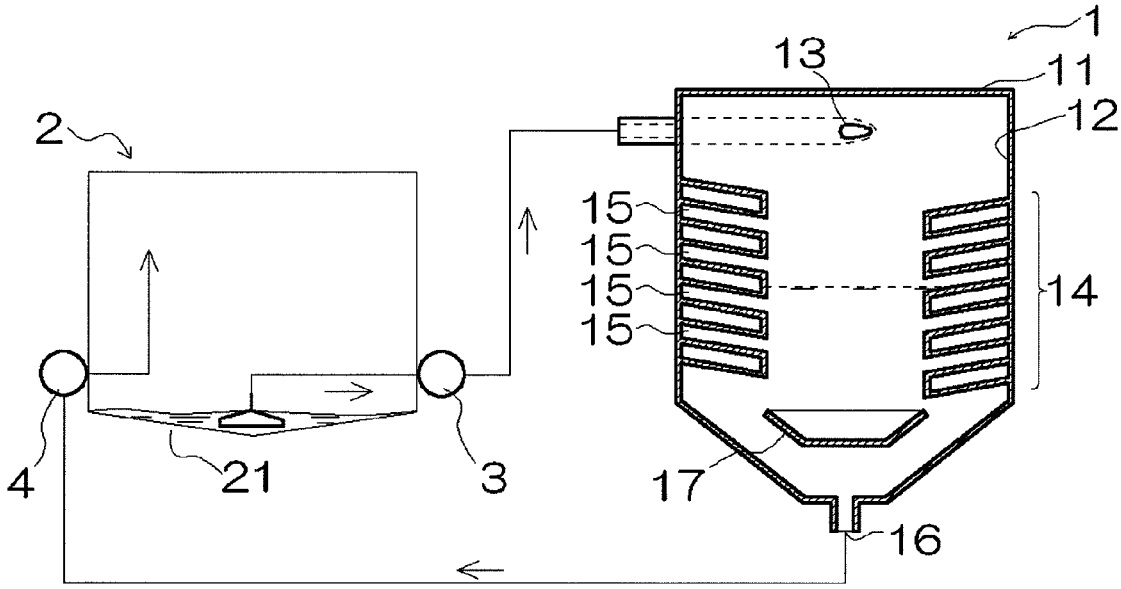
FIG. 1 is a schematic cross-sectional view illustrating a configuration of an oil tank structure of a first embodiment, including an object to be lubricated.
Figure 2:
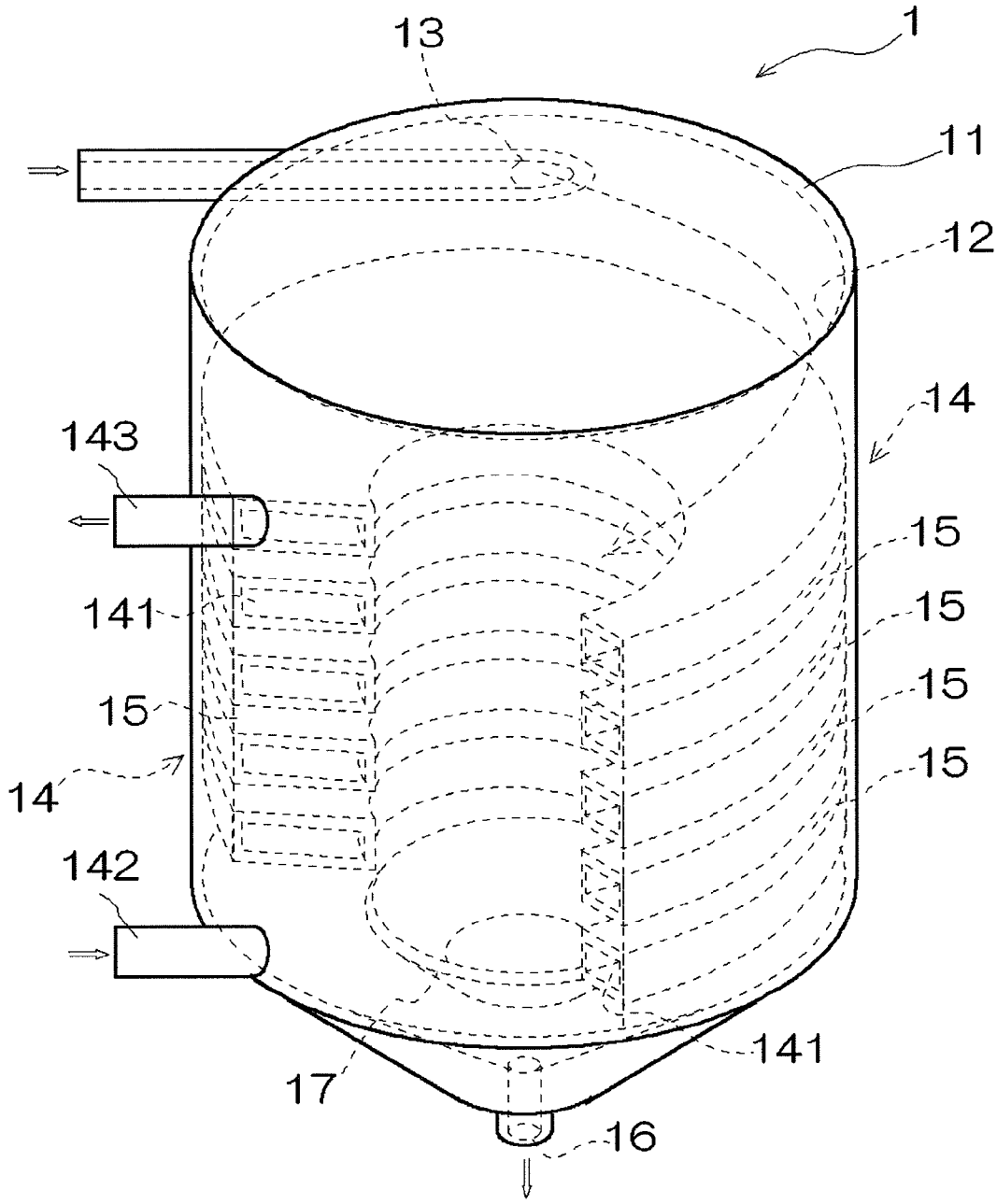
FIG. 2 is a schematic perspective view illustrating a configuration of the oil tank structure of the first embodiment, with an oil cooling portion partially cut away.
Figure 3:
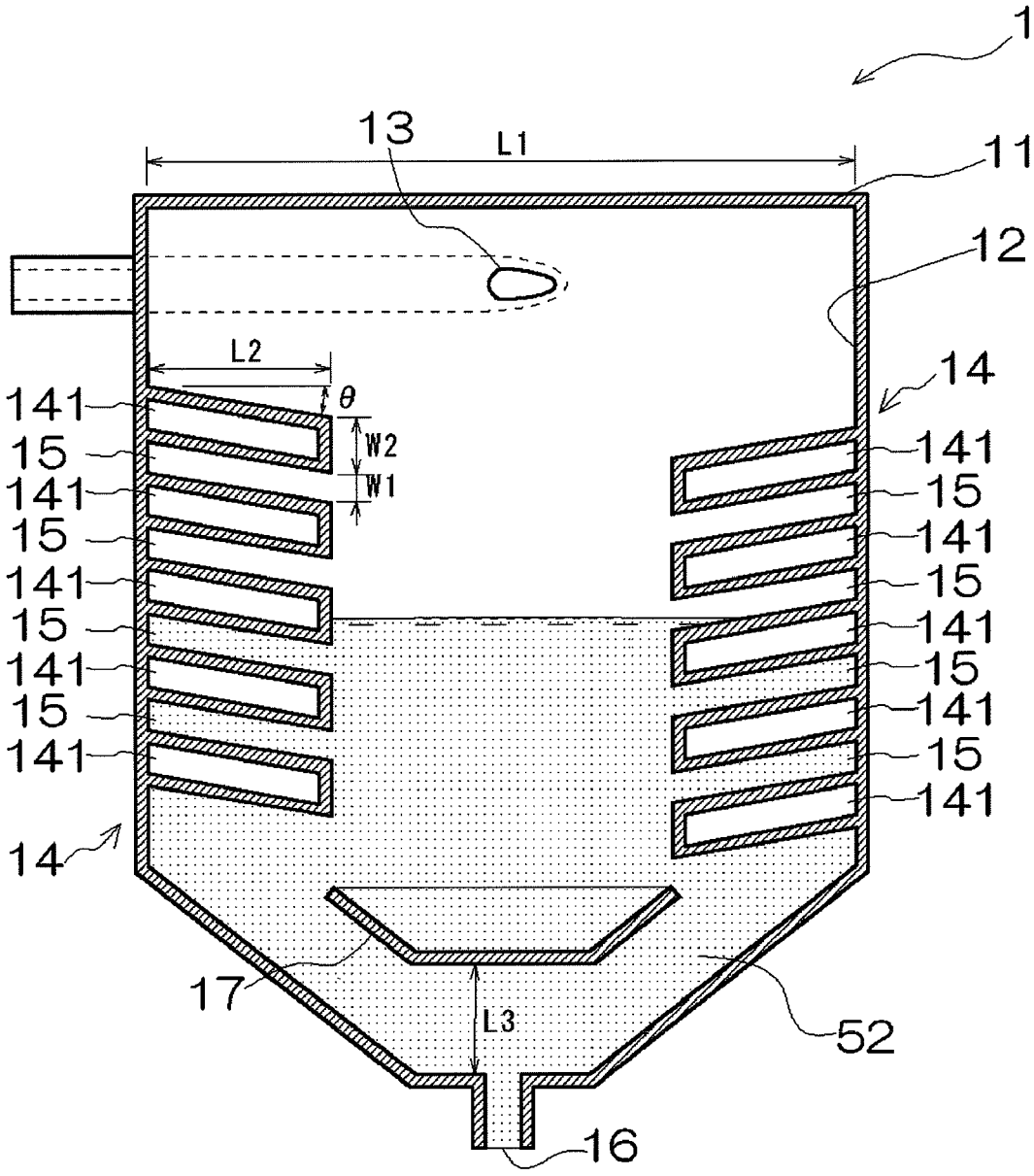
FIG. 3 is a schematic cross-sectional view illustrating a configuration of the oil tank structure of the first embodiment in a state where no oil has been introduced therein.

As exemplarily shown in FIGS. 1 through 3, the oil tank structure is characterized by including: a cylindrical tank portion 11; an oil introducing portion 13 that is provided in a sidewall 12 of the tank portion 11 and introduces oil in a direction tangential to the sidewall 12; an oil cooling portion 14 provided on the sidewall 12; at least one groove-like passage portion 15 that is formed along the circumference of the sidewall 12 so to allow the introduced oil to flow in and out of the groove-like passage portions 15; and an outlet 16 formed in the bottom of the tank portion 11. Moreover, the oil tank structure may further include a baffle portion 17 that is provided in the tank portion 11 so as to cover the outlet 16 from above.

The "high temperature" and the "low temperature" of the oil stored by the oil tank structure mean that the temperature of the oil flowing into the tank portion 11 is higher or lower than a predetermined temperature that is suitable for lubricating an object to be lubricated. Although various values are selected as the predetermined temperature according to the conditions, the predetermined temperature may be set to, for example, 100° C. In this case, the high temperature is 100° C. or higher, and the low temperature is lower than 100° C. Moreover, the temperature may be selected so that the oil temperature becomes equal to the predetermined temperature when the oil reaches the object to be lubricated.

The "tank portion 11" need only be able to store the oil that is used to lubricate an internal combustion engine, general machinery, and the like, and the shape, size, and material of the tank portion 11 may be arbitrarily selected. Moreover, the inner shape of the tank portion 11 includes the cylindrical sidewall 12, an opening of the oil introducing portion 13 is formed in the sidewall 12, and the outlet 16 for supplying stored oil 52 to a lubrication path for an object 2 to be lubricated is provided in the bottom of the tank portion 11.

Note that the form in which the oil is supplied from the outlet 16 to the lubrication path for the object 2 to be lubricated is not specifically limited.

The "oil introducing portion 13" is an inlet of the oil that is pressure-fed from the object 2 to be lubricated through a pump 3 and the like.

The "oil cooling portion 14" need only be able to cool the oil that flows inside the groove-like passage portion 15, and means for cooling the oil may be arbitrarily selected. For example, as exemplarily shown in FIGS. 2 and 3, a liquid cooling heat exchanger, in which a pipe 141 through which a cooling medium such as cooling water flows, and the groove-like passage portion 15 into which the oil flows, are made in contact with each other, can be used as the oil cooling portion 14. Moreover, as exemplarily shown in FIG. 9, an air cooling heat exchanger in which cooling fins 144, which are in contact with outside air, are provided in the groove-like passage portion 15 into which oil flows, can be used as the oil cooling portion 14. Moreover, a plurality of cooling means may be provided.

Note that, although the oil cooling portion 14 does not usually cool the stored oil and the like other than the oil flowing in the groove-like passage portion 15, the oil cooling portion 14 may cool the stored oil and the like.

The oil cooling portion 14 is provided on the sidewall 12 of the tank portion 11. As exemplarily shown in FIGS. 2 and 3, the oil cooling portion 14 may be provided on the sidewall 12 in the entire central portion of the tank portion 11, or may be provided on the entire sidewall 12, or may be provided above the level of the oil staying in the tank portion 11.

Figure 8:
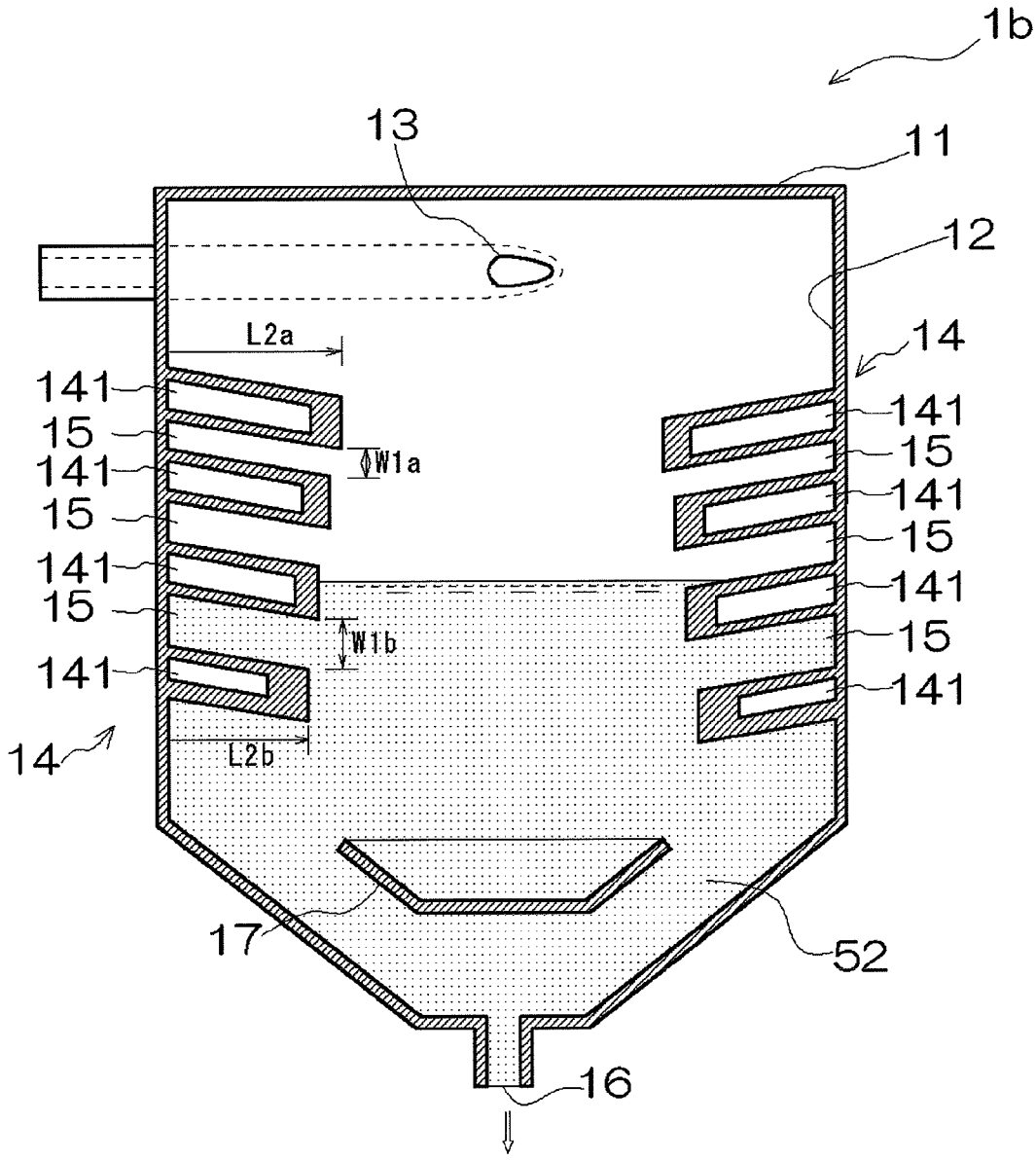
FIG. 8 is a schematic cross-sectional view illustrating a configuration of an oil tank structure of a third embodiment in a state where no oil has been introduced therein.

Moreover, the oil cooling portion 14 may be provided with cooling means such as a cooling pipe 141 so as to entirely cool the groove-like passage portion 15, as exemplarily shown in FIG. 3, or may be provided with cooling means such as a cooling pipe 141 so as to cool only the inside of the groove-like passage portion 15, as exemplarily shown in FIG. 8. In the case of cooling only the inside of the groove-like passage portion 15, no oil flows into the groove-like passage portion 15 when oil having a low temperature is introduced. Thus, oil having a low temperature is not cooled by the cooling means. Therefore, only oil having a high temperature can be cooled. Thus, the cooling ability of the tank structure associated with changes in oil temperature varies significantly, whereby over-cooling of the oil can be suppressed.

Figure 5:
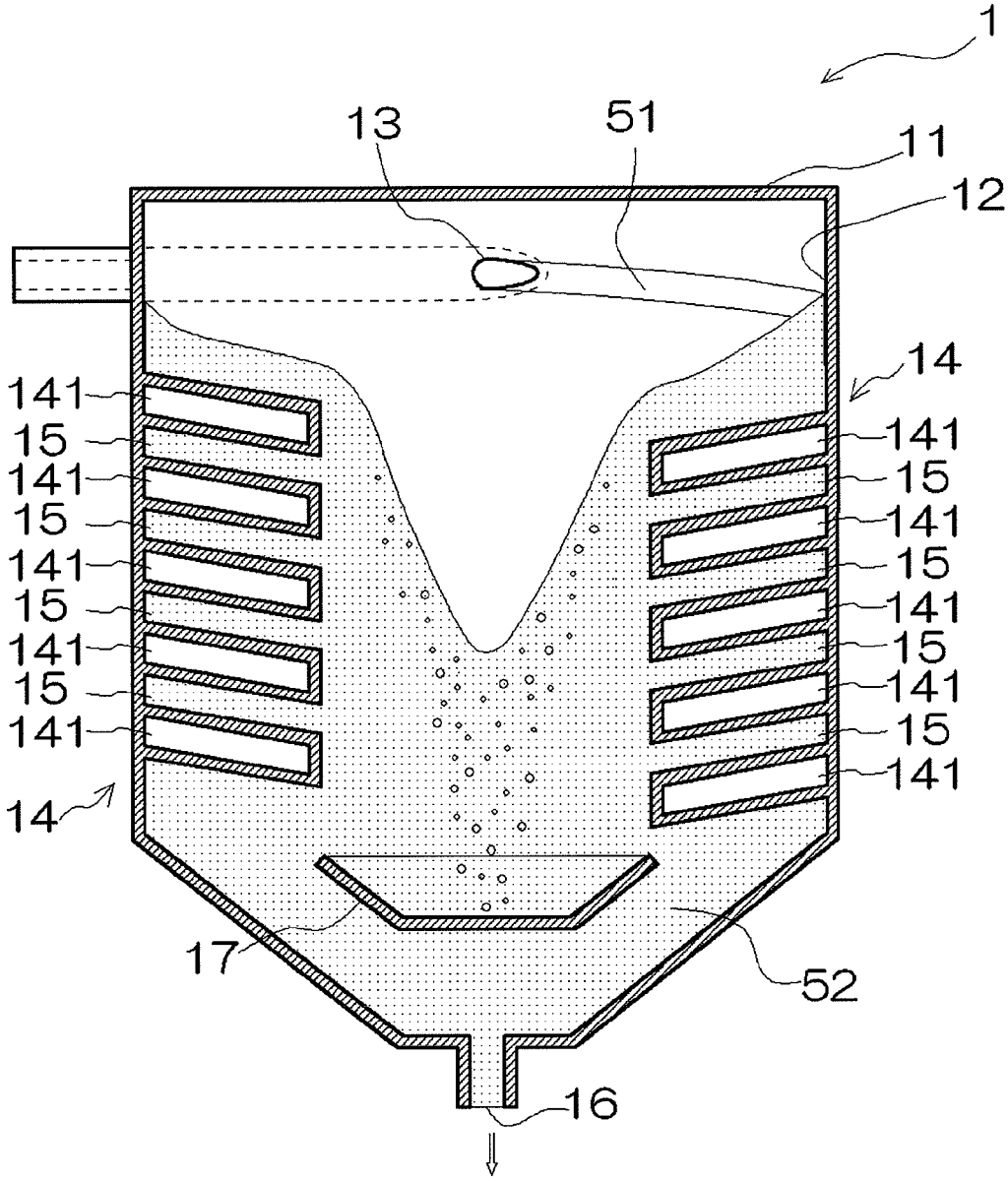
FIG. 5 is a schematic cross-sectional view illustrating a configuration of the oil tank structure of the first embodiment in the case where oil flowing in the oil tank structure has a high temperature.

The "groove-like passage portion 15" is a groove-like portion provided along a circumferential direction of the sidewall 12, and as exemplarily shown in FIG. 5, is a passage for passing oil 51, introduced from the oil introducing portion 13, through the groove to cool the oil 51 by the oil cooling portion 14. The groove-like passage portion 15 may have any shape as long as it is provided along the circumferential direction. For example, the groove-like passage portion 15 may have a spiral shape as exemplarily shown in FIGS. 2 and 3, or may have an annular shape as exemplarily shown in FIGS. 6 and 7. Moreover, the number of groove-like passage portions 15 can be selected arbitrarily. Only one groove-like passage portion 15 may be provided as exemplarily shown in FIGS. 2 and 3, or a plurality of groove-like passage portions 15 may be provided as exemplarily shown in FIGS. 6 and 7.

Moreover, exemplarily shown in FIGS. 2 and 3, the groove-like passage portion 15 may be provided so as to be tilted downward toward the central axis of the sidewall 12. Tilting the groove-like passage portion 15 by a tilt angle θ exemplarily shown by FIG. 3 enables oil having a higher temperature to more easily flow into the groove-like passage portion 15, and at the same time, can help the oil flowing downward, and can prevent the oil from flowing upward. Although the tilt angle θ is selected as appropriate according to the oil viscosity and the flow rate of the oil when introduced into the tank portion 11, the size of the tank portion 11, and the material of the groove-like passage portion 15, and the like, the tilt angle θ can be set to 2 to 60° (preferably 5 to 30°) in the case of, for example, oil for internal combustion engines.

Moreover, a groove width W1 of the groove-like passage portion 15 exemplarily shown in FIG. 3 may be arbitrarily selected. Especially, the groove width W1 may be selected so that the introduced oil 51 having a low temperature does not flow into the groove-like passage portion 15 by the momentum thereof, as exemplarily shown in FIG. 4, and the oil 51 having a high temperature flows into the groove-like passage portion 15 by the momentum thereof, as exemplarily shown in FIG. 5. The reason for this is that the oil 51 introduced from the oil introducing portion 13 swirls along the sidewall 12 and reaches the groove-like passage portion 15 by the momentum thereof caused when introduced from the oil introducing portion 13, but it is preferable that only the oil having a high temperature flow into the groove-like passage portion 15 and be cooled by the oil cooling portion 14.

Figure 4:
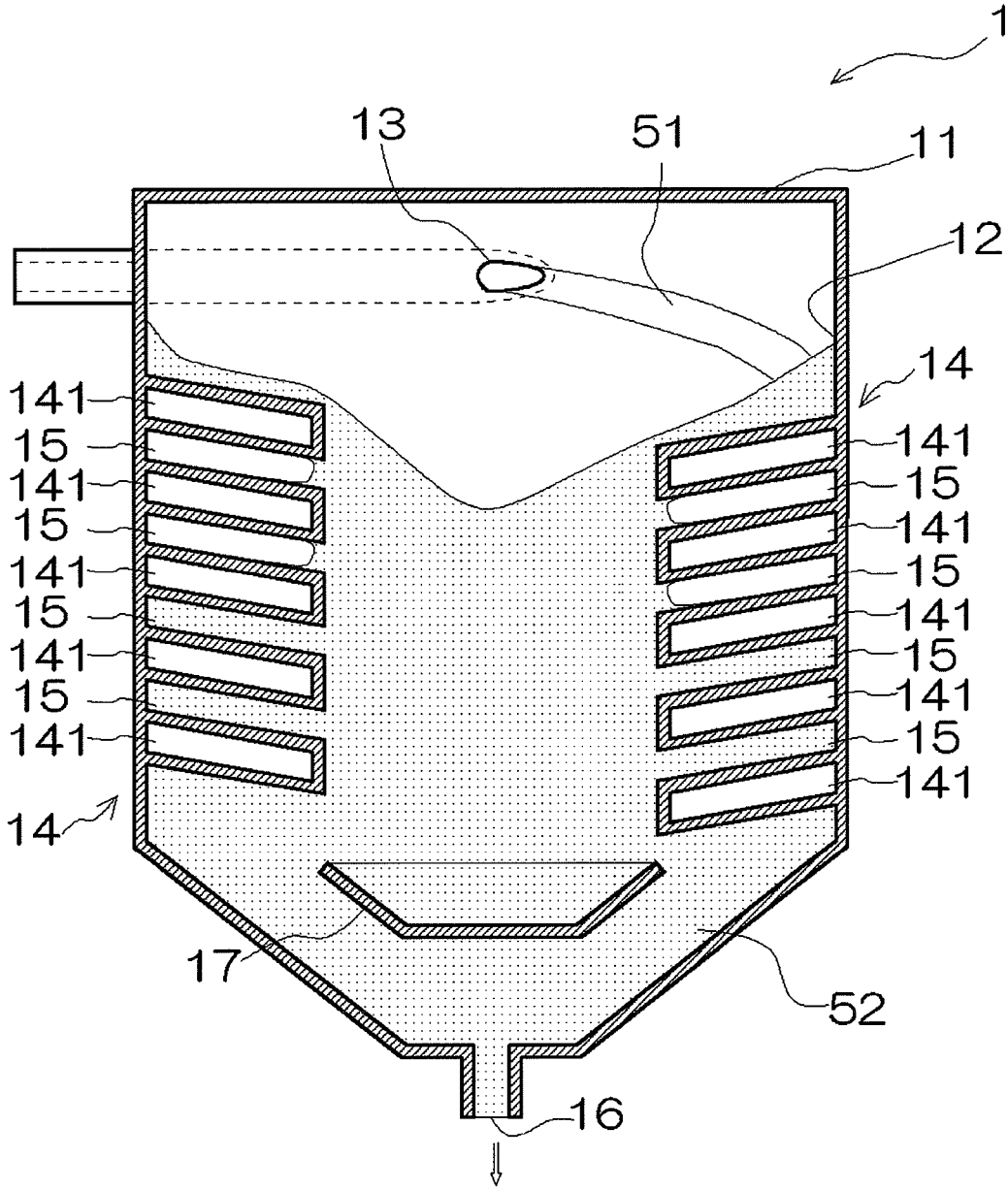
FIG. 4 is a schematic cross-sectional view illustrating a configuration of the oil tank structure of the first embodiment in the case where oil flowing in the oil tank structure has a low temperature.

The reason why only the oil having a high temperature can flow into the groove-like passage portion 15 by arbitrarily selecting the groove width W1 is that oil having a low temperature has higher viscosity and a higher surface tension than those of the oil having a high temperature, and is less likely to wet an object contacted by the oil, and thus, the oil stops at a shallow part in the groove-like passage portion 15, as exemplarily shown in FIG. 4. On the other hand, the oil having a high temperature has lower viscosity and a lower surface tension, and is more likely to wet the groove-like passage portion 15, and thus, the oil flows to the bottom of the groove-like passage portion 15, as exemplarily shown in FIG. 5.

Although the width W1 varies as appropriate according to the viscosity and the surface tension of the oil to be used, and the flow rate of the oil when introduced into the tank portion 11, the size of the tank portion 11, and the material of the groove-like passage portion 15, and the like, the width W1 can be set to 1 to 10 mm (preferably 1 to 5 mm) in the case of, for example, oil for internal combustion engines.

Moreover, a groove depth L2 of the groove-like passage portion 15 exemplarily shown in FIG. 3 may be selected arbitrarily. Especially, the depth L2 is preferably such a depth that enables the introduced oil having a high temperature to reach the groove-like passage portion 15 by the momentum thereof. Although the depth L2 varies as appropriate according to the viscosity and the surface tension of the oil used, the flow rate of the oil when introduced into the tank portion 11, the size of the tank portion 11, and the material of the groove-like passage portion 15, and the like, the depth L2 can be set to 20 to 60 mm (preferably 30 to 50 mm) in the case of, for example, oil for internal combustion engines. The depth L2 in such a range can be normally applied when the tank portion 11 exemplarily shown in FIG. 3 has an inner diameter of about 150 to 250 mm, but the present invention is not limited to this.

Moreover, in the case where the width W1 and the depth L2 in the example of the oil for internal combustion engines are combined, the width W1 of 1 to 5 mm and the depth L2 of 30 to 50 mm, and the like can be used as an example.

Moreover, the groove width W1 and the groove depth L2 of the groove-like passage portion 15 exemplarily shown in FIG. 3 may be constant, but may be varied according to the position on the sidewall 12 of the tank portion 11. For example, as exemplarily shown in FIG. 8, the groove-like passage portion 15 may be provided so that the groove depth gradually decreases from an upper position to a lower position on the sidewall 12, and the groove width gradually increases from an upper position to a lower position on the sidewall 12. This is because even the oil having a flow rate gradually reduced by swirling in the tank portion 11 can easily flow into the groove-like passage portion 15 and can be cooled by the oil cooling portion 14.

Moreover, in the case where the grooves of the groove-like passage portion 15 extend in parallel as exemplarily shown in FIG. 3, a gap W2 therebetween may be selected arbitrarily. Moreover, the gap W2 may be constant at every position, or may be varied according to the position on the sidewall 12 of the tank portion 11.

As exemplarily shown in FIG. 3, the "baffle portion 17" is a plate-like body that is provided at a position in the tank portion 11. The position is a position that can prevent a level of the stored oil 52 or air bubbles, which are produced when the introduced oil 51 is poured into the stored oil 52 as exemplarily shown in FIG. 5, for example, from directly reaching the outlet 16. Such a position may be a position that covers the outlet 16 from above, as exemplarily shown in, for example, FIGS. 2 and 3. A distance L3 between the baffle portion 17 and the outlet 16 may be selected arbitrarily. Moreover, the shape of the baffle portion 17 may be selected arbitrarily, and a flat plate, a flat plate having tilted edges (see FIG. 3), a curved plate, or the like can be used as an example of the baffle portion 17.

[Embodiments]

Hereinafter, the oil tank structure of the present invention will be described specifically in terms of embodiments with reference to the accompanying drawings.

An oil tank structure of each embodiment is a structure of an oil tank 1 for storing oil to be used to lubricate an internal combustion engine 2 as shown in FIG. 1. The oil that has passed through a lubrication path is first collected in an oil pan 21, and thereafter, is pressure-fed to the oil tank 1 by a first pump 3, and then is stored in the oil tank 1. Moreover, the oil stored in the oil tank 1 is discharged from an outlet 16, and is supplied to the lubrication path of the internal combustion engine 2 by a second pump 4.

1. First Embodiment (1) Oil Tank Structure

An oil tank structure of a first embodiment is a structure of the oil tank 1 including a groove-like passage portion provided in a spiral shape, and as shown in FIGS. 2 through 4, includes a tank portion 11, an oil introducing portion 13, an oil cooling portion 14, a groove-like passage portion 15, an outlet 16, and a baffle portion 17.

The tank portion 11 is a container having a cylindrical sidewall 12 having an inner diameter of about 150 mm. The tank portion 11 has an opening of the oil introducing portion 13 in an upper part of the sidewall 12, and has the outlet 16 at the bottom of the tank portion 11, where the outlet 16 is connected to a passage to the second pump 4.

The oil introducing portion 13 is provided in the upper part of the sidewall 12, and introduces oil in a direction tangential to the sidewall 12. Thus, as shown in FIGS. 4 and 5, oil 51 flows down to the level of stored oil 52 while swirling along the sidewall 12.

The groove-like passage portion 15 is a spiral groove provided along the circumference of the sidewall 12 from a position under the position where the oil introducing portion 13 is provided to the lower side of the sidewall 12. Moreover, the width W1 is set to about 3 mm and the tilt angle θ is set to about 10° as shown in FIG. 3 so that the introduced oil 51 flows into the groove-like passage portion 15 only when the oil temperature is as high as about 100° C. as shown in FIGS. 4 and 5. Moreover, the groove depth L2 is set to about 40 mm.

The oil cooling portion 14 is a water cooling heat exchanger for cooling oil, which is formed by a cooling pipe 141 through which cooling water flows. The cooling pipe 141 is provided between grooves of the groove-like passage portion 15 on the sidewall 12 and at positions adjacent to the grooves. Moreover, the cooling water, which flows through the cooling pipe 141, is introduced from an external cooling water circulating circuit through a cooling water inlet 142 shown in FIG. 2, flows through the cooling pipe 141, and then, is discharged from a cooling water outlet 143 to the cooling water circulating circuit.

The baffle portion 17 is a circular plate having its center located about 10 mm away from the outlet 16, and having its periphery bent upward.

(2) Operation of the Oil Tank Structure

As shown in FIGS. 4 and 5, the oil 51, which is introduced into the oil tank 1 having such an oil tank structure, is introduced from the oil introducing portion 13 and flows down to the level of the stored oil 52 while swirling along the sidewall 12. Moreover, since the oil 51 mixes with the stored oil 52 while swirling, the stored oil 52 also swirls in the same direction, and the periphery of the oil rises in a cone shape along the sidewall 12 due to the swirling force.

Moreover, when the oil has a low temperature, as exemplarily shown in FIG. 4, the oil adheres to the periphery of the groove-like passage portion 15, but its high viscosity causes a large resistance to further inflow of the oil, preventing the oil from flowing into the groove-like passage portion 15. On the other hand, when the oil has a high temperature, as shown in FIG. 5, the oil easily flows into the groove-like passage portion 15 due to its low viscosity, and is cooled by the oil cooling portion 14.

Thus, the oil temperature in the tank portion 11 can be prevented from becoming higher than an appropriate temperature range. Moreover, when the oil temperature is low, such as when the internal combustion engine is started or the like, the oil re-lubricates the object to be lubricated without being cooled by the oil cooling portion 14. Thus, the time it takes for the oil temperature to increase to an appropriate temperature can be reduced.

The oil 52, which has reached the appropriate temperature and has been stored, is discharged from the outlet 16, and supplied to the lubrication path of the internal combustion engine 2.

Moreover, as shown in FIGS. 3 and 4, the stored oil 52, which has flown into the groove-like passage portion 15, easily flows in and out of the groove-like passage 15 when the oil temperature is high. However, when the oil temperature is low, oil has low fluidity due to its high viscosity and the like, and this oil 52 stays inside the groove-like passage portion 15 even if stirring is caused by the introduced oil 51. Thus, all of the remaining stored oil 52 can be prevented from flowing in and out of the groove-like passage portion 15. Therefore, when the stored oil 52 has a low temperature, not all of the oil 52 is cooled by the groove-like passage 15 located under the level of the oil 52.

Furthermore, the resistance, which is produced by the oil flowing into the circumferentially provided groove-like passage portion 15, prevents the oil 52 from easily moving in a vertical direction of the tank portion 11, whereby the height of the level of the stored oil 52 that is stirred by the introduced oil 51 can be prevented from varying significantly.

In addition, by preventing air bubbles and the like from reaching the outlet 16 by the baffle portion 17, the oil 52 mixed with air bubbles can be prevented from being supplied again to the lubrication path.

2. Second Embodiment

Figure 6:
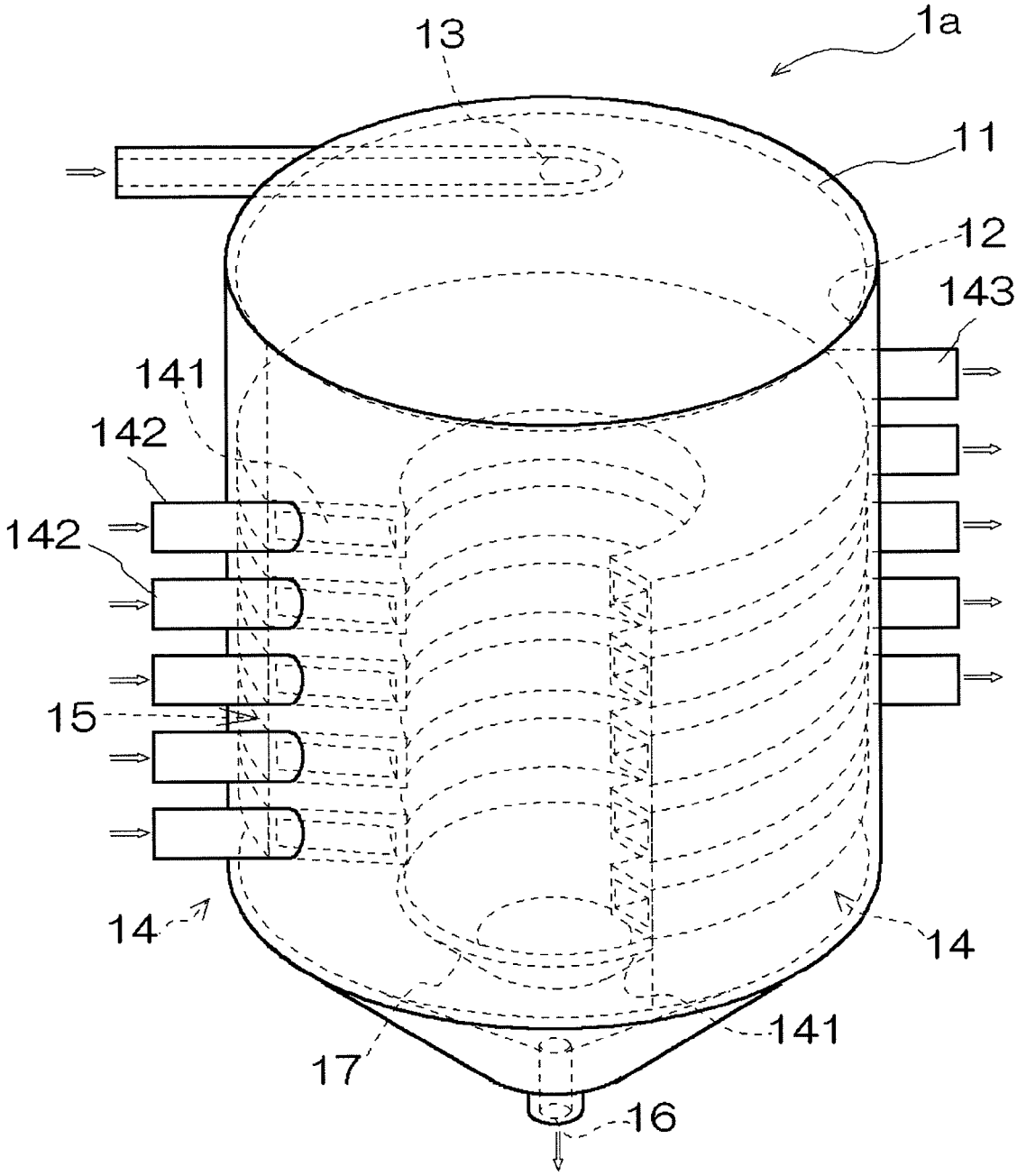
FIG. 6 is a schematic perspective view illustrating a configuration of an oil tank structure having annular groove-like passage portions according to a second embodiment, with an oil cooling portion partially cut away.
Figure 7:
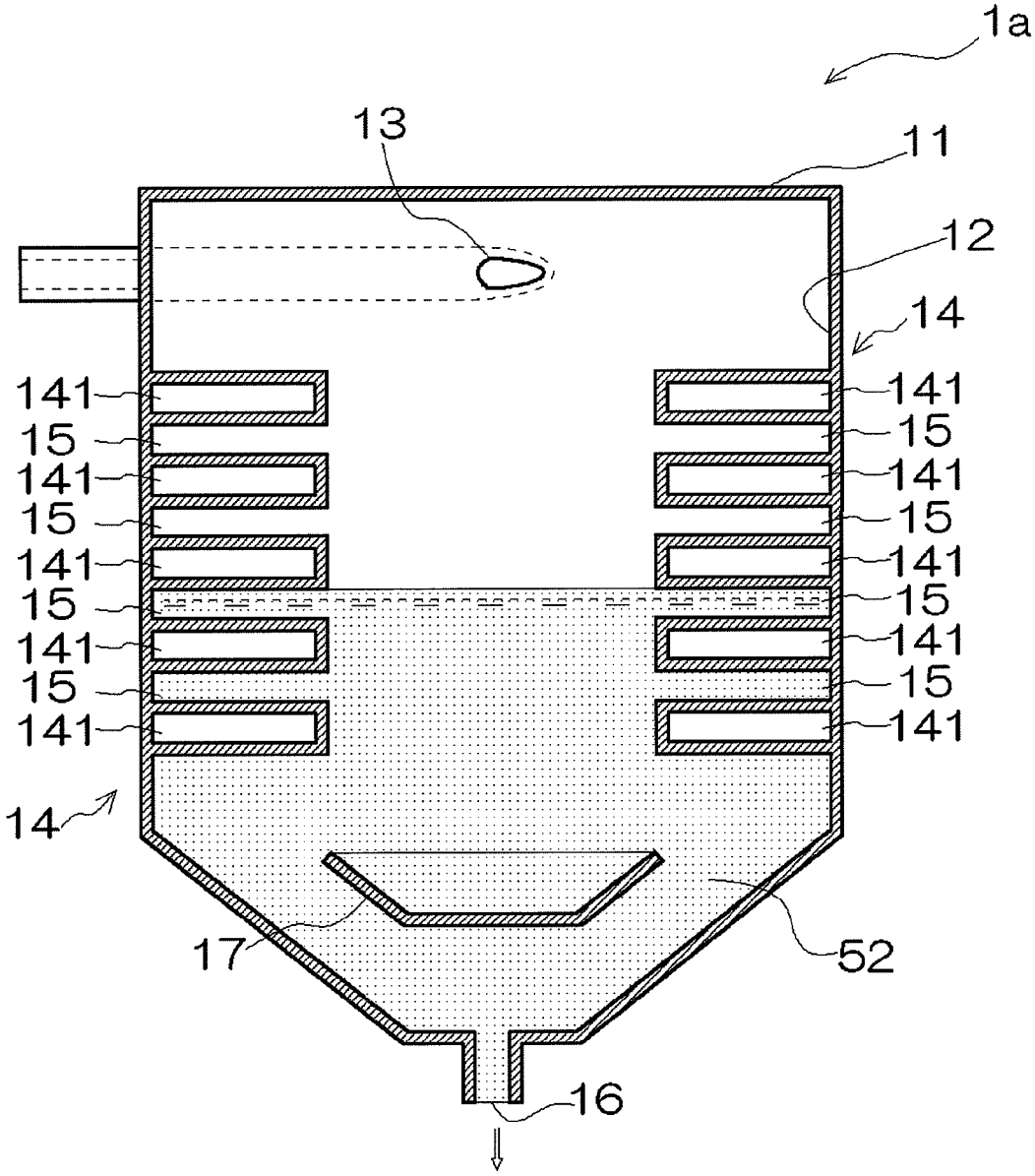
FIG. 7 is a schematic cross-sectional view illustrating a configuration of the oil tank structure of the second embodiment in a state where no oil has been introduced therein.

An oil tank structure of a second embodiment is a structure of an oil tank la having a structure similar to that of the first embodiment except that the oil tank la includes annular groove-like passage portions 15 shown in FIGS. 6 and 7. As shown in FIGS. 6 and 7, the oil tank structure of the second embodiment includes a tank portion 11, an oil introducing portion 13, an oil cooling portion 14, groove-like passage portions 15, an outlet 16, and a baffle portion 17. Of these components, the tank portion 11, the oil introducing portion 13, the outlet 16, and the baffle portion 17 are similar to those of the first embodiment, and thus, description thereof will be omitted.

The groove-like passage portions 15 of the second embodiment have an annular shape, and are vertically arranged at four positions along a sidewall 12.

Moreover, the oil cooling portion 14 includes annular cooling pipes 141, which are provided above and below each groove-like passage portion 15. Moreover, each cooling pipe 141 is provided with a cooling water inlet 142 and a cooling water outlet 143 so that cooling water circulates.

As in the first embodiment having the spiral groove-like passage portion 15, in the oil tank 1*a* having such an oil tank structure, oil easily flows into the groove-like passage portions 15 and is cooled by the oil cooling portion 14, only when the oil temperature is high. Thus, the oil temperature in the tank portion 11 can be prevented from becoming higher than an appropriate temperature range, as in the first embodiment.

3. Third Embodiment

An oil tank structure of a third embodiment is a structure of an oil tank 1*b* having a structure similar to that of the first embodiment except that the oil tank 1*b* includes a spiral groove-like passage portion 15 having its groove depth L2 gradually decreased and its groove width gradually increased toward downward as shown in FIG. 8. As shown in FIG. 8, the oil tank structure of the third embodiment includes a tank portion 11, an oil introducing portion 13, an oil cooling portion 14, a groove-like passage portion 15, an outlet 16, and a baffle portion 17. Of these components, the tank portion 11, the oil introducing portion 13, the oil cooling portion 14, the outlet 16, and the baffle portion 17 are similar to those of the first embodiment, and thus, description thereof will be omitted.

The groove-like passage portion 15 of the third embodiment has a spiral shape like the groove-like passage portion 15 of the first embodiment, where a topmost groove depth L2*a* is about 40 mm, and a topmost groove width W1*a* is about 3 mm. However, the grooves become shallower and wider toward downward, and a bottommost groove depth L2*b* is about 30 mm, and a bottommost groove width W1*b* is about 5 mm. Moreover, a part of the groove-like passage portion 15 on a side of the central axis of a sidewall 12 is farther from a cooling pipe 141 than another part of the groove-like passage portion 15, so that only the inside of the grove-like passage portion 15 is cooled by the cooling pipe 141. That is, a wall portion of the cooling pipe 141 on the side of the central axis of the sidewall 12 has a larger wall thickness than other part of the cooling pipe 141, so that the oil that is in contact with this wall portion is less likely to be subjected to heat exchange than the oil that flows into the groove-like passage portion 15, and cooling of the oil flowing into the groove-like passage portion 15 by the cooling pipe 141 is further facilitated.

In the oil tank 1*b* including such a groove-like passage portion 15, even the oil having a flow rate gradually reduced by swirling in the tank portion 11 can easily flow into the groove-like passage portion 15, and can be cooled by the oil cooling portion 14. Moreover, since only the inside of the groove-like passage portion 15 is cooled by the oil cooling portion 14, no oil flows into the groove-like passage portion 15 when oil having a low temperature is introduced. Thus, oil having a low temperature is not cooled by the cooling means. Therefore, only oil having a high temperature can be cooled. Thus, the cooling ability of this tank structure associated with changes in oil temperature varies significantly, whereby over-cooling of the oil can further be suppressed.

4. Fourth Embodiment

Figure 9:
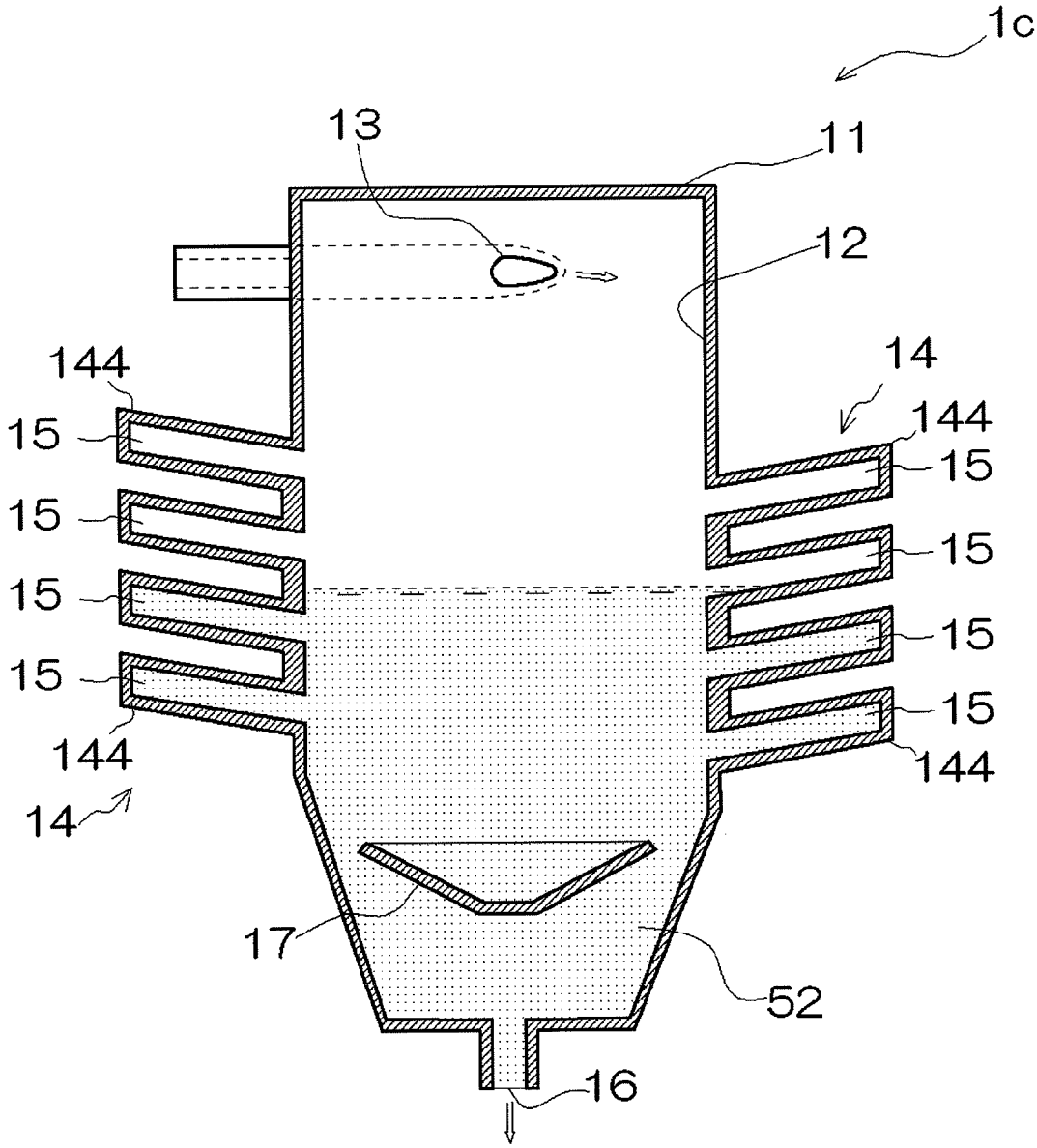
FIG. 9 is a schematic cross-sectional view illustrating a configuration of an oil tank structure of a fourth embodiment in a state where no oil has been introduced therein.

An oil tank structure of a fourth embodiment is a structure of an oil tank 1*c* having a structure similar to that of the first embodiment except that the oil tank 1*c* includes an air cooling type oil cooling portion 14. As shown in FIG. 9, the oil tank structure of the fourth embodiment includes a tank portion 11, an oil introducing portion 13, an oil cooling portion 14, a groove-like passage portion 15, an outlet 16, and a baffle portion 17. Of these components, the oil introducing portion 13, the groove-like passage portion 15, the outlet 16, and the baffle portion 17 are similar to those of the first embodiment, and thus, description thereof will be omitted.

The tank portion 11 is a container having a cylindrical sidewall 12 similar to that of the first embodiment. The tank portion 11 has an opening of the oil introducing portion 13 in an upper part of the sidewall 12, and has the outlet 16 at the bottom of the tank portion 11, where the outlet 16 is connected to a passage to a second pump 4.

Moreover, the oil cooling portion 14 has an air cooling structure in which wall portions and bottom portions of the groove-like passage portion 15 are exposed to the outside as cooling fins 144. Moreover, at a part of the groove-like passage portion 15 on a side of the central axis of the sidewall 12, the wall thickness is made larger than that of another part of the groove-like passage portion 15, so that only the inside of the groove-like passage portion 15 is cooled by outside air. That is, the sidewall 12 between the grooves of the groove-like passage portion 15 has a larger wall thickness than that of other part of the sidewall 12, whereby the oil that is in contact with this part of the sidewall 12 is less likely to be subjected to heat exchange than the oil that flows into the groove-like passage portion 15. Thus, cooling of the oil by heat exchange with the outside air is facilitated more for the oil that flows into the groove-like passage portion 15.

The oil tank 1 of the fourth embodiment can prevent the oil temperature in the tank portion 11 from becoming higher than an appropriate temperature range in a manner similar to that of the first embodiment, by using the air cooling type oil cooling portion 14. Moreover, when the oil temperature is low, such as when the internal combustion engine is started or the like, the oil re-lubricates the object to be lubricated without being cooled by the oil cooling portion 14. Thus, the time it takes for the oil temperature to increase to an appropriate temperature can be reduced.

The invention claimed is:

1. An oil tank structure, comprising:

a cylindrical tank;

an oil introducer that is provided in a sidewall of said cylindrical tank and introduces oil in a direction tangential to said sidewall;

at least one groove-like passage that is provided along a circumference of said sidewall of said cylindrical tank to allow said introduced oil to flow in and out of said groove-like passage;

an oil cooler that is provided on said sidewall of said cylindrical tank and cools said groove-like passage; and an outlet in a bottom of said cylindrical tank, wherein said groove-like passage has an opening on a side of a central axis of said sidewall of said cylindrical tank, and said groove-like passage is provided such that at least one of: a groove depth thereof gradually decreases from an upper position to a lower position on said sidewall, and a groove width gradually increases from said upper position to said lower position on said sidewall.

2. The oil tank structure according to claim 1, wherein a width of said groove-like passage is such that said introduced oil does not flow into said groove-like passage by a momentum of said oil when said oil has a low temperature, and said introduced oil flows into said groove-like passage by a momentum of said oil when said oil has a high temperature.

3. The oil tank structure according to claim 1, wherein said groove-like passage is provided in a spiral shape so as to extend downward along a direction in which said oil is introduced.

4. The oil tank structure according to claim 1, further comprising:

a baffle provided within said cylindrical tank as to cover said outlet from above.

5. The oil tank structure according to claim 2, wherein said groove-like passage is provided in a spiral shape so as to extend downward along a direction in which said oil is introduced.

6. An oil tank structure, comprising:

a cylindrical tank;

an oil introducer that is provided in a sidewall of said cylindrical tank and introduces oil in a direction tangential to said sidewall;

at least one groove-like passage that is provided along a circumference of said sidewall of said cylindrical tank to allow said introduced oil to flow in and out of said groove-like passage;

an oil cooler that is provided on said sidewall of said cylindrical tank and cools said groove-like passage; and an outlet in a bottom of said cylindrical tank, wherein said groove-like passage has an opening on a side of a central axis of said sidewall of said cylindrical tank, and said groove-like passage is tilted downward toward said central axis of said sidewall of said cylindrical tank.

7. The oil tank structure according to claim 6, wherein a width of said groove-like passage is such that said introduced oil does not flow into said groove-like passage by a momentum of said oil when said oil has a low temperature, and said introduced oil flows into said groove-like passage by a momentum of said oil when said oil has a high temperature.

8. The oil tank structure according to claim 6, wherein said groove-like passage is provided in a spiral shape so as to extend downward along a direction in which said oil is introduced.

9. The oil tank structure according to claim 6, wherein said groove-like passage is provided such that a groove depth thereof gradually decreases from an upper position to a lower position on said sidewall, and/or a groove width gradually increases from said upper position to said lower position on said sidewall.

10. The oil tank structure according to claim 7, wherein said groove-like passage is provided in a spiral shape so as to extend downward along a direction in which said oil is introduced.

11. The oil tank structure according to claim 7, wherein said groove-like passage is provided such that a groove depth thereof gradually decreases from an upper position to a lower position on said sidewall, and/or a groove width gradually increases from said upper position to said lower position on said sidewall.

12. The oil tank structure according to claim 8, wherein said groove-like passage is provided such that a groove depth thereof gradually decreases from an upper position to a lower position on said sidewall, and/or a groove width gradually increases from said upper position to said lower position on said sidewall.

13. The oil tank structure according to claim 10, wherein said groove-like passage is provided such that a groove depth thereof gradually decreases from an upper position to a lower position on said sidewall, and/or a groove width gradually increases from said upper position to said lower position on said sidewall.

14. The oil tank structure according to claim 13, further comprising:

a baffle provided within said cylindrical tank as to cover said outlet from above.

* * * * *